US005762114A

United States Patent [19]

Petersen

[11] Patent Number: 5,762,114

[45] Date of Patent: Jun. 9, 1998

[54] MARINE FUEL OVERFILL RECOVERY SYSTEM

[76] Inventor: Marvin R. Petersen, 30 Bonnie Brier Cir., Hingham, Mass. 02043

[21] Appl. No.: 657,652

[22] Filed: Jun. 3, 1996

[51] Int. Cl.[6] ..... B65B 1/04

[52] U.S. Cl. ..... 141/86; 141/311 A; 114/343; 114/364

[58] Field of Search ..... 141/59, 86, 87, 141/88, 311 A, 346, 383, 384, 386; 114/343, 364; 137/314, 312; 220/573; 285/161, 24, 27, 320, 179

[56] References Cited

U.S. PATENT DOCUMENTS

| | | | |
|---|---|---|---|
| 4,082,125 | 4/1978 | Wilson et al. . | |
| 4,678,207 | 7/1987 | Dornbracht et al. | 285/161 |
| 4,802,514 | 2/1989 | Morse . | |
| 5,070,806 | 12/1991 | Coster . | |
| 5,230,372 | 7/1993 | Westphal . | |
| 5,293,913 | 3/1994 | Preszler | 141/346 |
| 5,402,837 | 4/1995 | Dietzen | 220/573 |
| 5,467,806 | 11/1995 | Stricklin et al. | 141/346 |

OTHER PUBLICATIONS

Product Brochure, "The Gas Guzzler" (no date available).

*Primary Examiner*—Henry J. Recla
*Assistant Examiner*—Steven O. Douglas
*Attorney, Agent, or Firm*—Cesari and McKenna, LLP

[57] ABSTRACT

A fuel recovery system catches fuel inadvertently forced from a vent fitting in a boat while the boat is refueled, travels about or is stored. A coupler detachably mates with the vent fitting and coacting means on the vent fitting and the coupler secure the coupler to the vent fitting. A substantially closed recovery tank is connected to the coupler and is in fluid communication with the vent fitting when the coupler is mated with the vent fitting. Fuel inadvertently discharged through the vent fitting flows into, and is thereafter stored by, the recovery tank.

9 Claims, 4 Drawing Sheets

MARINE FUEL OVERFILL RECOVERY SYSTEM

BACKGROUND OF THE INVENTION

1. Field of the Invention

The invention relates to boat accessories, and more particularly to accessories that prevent fuel from spilling from a boat's fuel tank into a body of water adjacent the boat.

2. Description of the Related Art

A motorized boat typically employs an internally-mounted fuel tank to store fuel for the engine that powers the boat. The tank is filled through a filler neck, which is connected to it by appropriate plumbing. Regulations require the fuel tank to be vented to a location outside the boat's hull to prevent a buildup of explosive fuel vapors inside the hull. Typically, a vent fitting is mounted in the hull of the boat and is connected by additional plumbing to the fuel tank. The vent fitting is usually L-shaped with an L-shaped bore or hollow therethrough. Specifically, a horizontal part of the fitting extends through a hole in the hull and connects to the additional plumbing, while a vertical arm of the bore defines a downwardly-extending hole in the vent fitting. A screen covers the hole to prevent foreign substances, especially sparks, from entering the vent fitting.

Problematically, fuel is often inadvertently discharged through the vent fitting, e.g. when the fuel tank is overfilled on refueling; when the boat accelerates, travels at high speed or travels over rough water with a full tank; or when heat causes fuel in the fuel tank to expand beyond the tank's capacity.

To prevent water pollution, regulations often forbid discharging fuel into the adjacent water, so various devices and techniques have been developed to catch the fuel that is discharged through the vent fitting. However, these devices and techniques are applicable only to a refueling scenario and even then they are deficient.

Some prior devices include a catch basin that attaches to the boat, below the vent fitting. Problematically, such open systems permit fuel to splash out of the basin and permit evaporating fuel to pollute the air. Other devices provide a tank that connects to the vent fitting, but these devices are intended for use during refueling and are not designed to remain connected as the boat travels about. In another prior device, a tank is suspended by a tether and stabilized by a suction cup attached to the boat's hull. However, dirt or decorative decals on the hull can prevent the suction cup from holding fast because the suction cup requires a very smooth surface to which to attach. Furthermore, the suction cup tends to detach when the boat accelerates or travels over rough water.

Another prior device provides a floating-ball valve installed between the fuel tank and the vent fitting to allow gases, but not liquids, to escape through the vent fitting. The valve is designed to shut when the fuel tank becomes full and fuel enters the plumbing between the fuel tank and the vent fitting. Problematically, when the valve suddenly shuts during a refueling operation, fuel can splash back out of the filler neck ("splash-back") due to a consequential sudden increase in pressure in the fuel tank. Furthermore, the valve is unreliable and its location in the boat makes it difficult to service or replace. Even on boats that do not have such a valve, splash-back often occurs during a refueling operation when the tank becomes full and fuel reaches the vent fitting because the vent fitting restricts the flow of fuel therethrough.

These prior devices have apparently not proven successful, since most boat owners merely hold a towel or other absorbent cloth below the vent fitting while their boat is being refueled. This practice is tedious and imperfect. It is also dangerous because it produces a highly flammable, fuel-soaked rag. Furthermore, many decorative boat decals and paint finishes are damaged by fuel inevitably smeared on them by this practice.

SUMMARY OF THE INVENTION

The present invention provides a fuel recovery system that catches fuel inadvertently forced from a vent fitting in a boat while the boat is refueled, travels about or is stored. The system provides a coupler for detachably mating with the vent fitting and coacting means on the vent fitting and the coupler for securing the coupler to the vent fitting so that the coupler does not detach from the vent fitting even when the boat travels at high speed or over rough water. The system also includes a substantially closed recovery tank connected to the coupler and thereby in fluid communication with the vent fitting while the coupler is mated with the vent fitting. Fuel inadvertently discharged through the vent fitting flows into, and is thereafter stored by, the recovery tank. The substantially closed recovery tank prevents recovered fuel from evaporating or splashing out of the recovery tank. Preferably, the recovery tank has a valve and a drain to facilitate reintroducing the recovered fuel into the boat's fuel tank through the filler neck.

The invention also includes an improved vent fitting that can be used with or without the above-described apparatus. In conventional vent fittings, the horizontal and vertical arms of the L-shaped bore form an angle of about 90°. I have found that an angle of between about 100° and 180° significantly reduces the likelihood of splash-back during refueling because such an angle introduces less resistance to the flow of fuel through the vent fitting. During a refueling operation involving a conventional vent fitting, pressure in the fuel tank increases suddenly when fuel reaches the 90° angle, whereas a greater-than-90° angle prevents this sudden pressure increase.

In addition to preventing water pollution when a boat is refueled or travels about, the system can prevent a fire hazard when the boat is stored, e.g. in a barn during a winter. The boat is typically stored with a full fuel tank to prevent corrosion of the inside of the fuel tank. Advantageously, the system can remain attached during this storage period and thus catch fuel that spills from the vent fitting when heat causes the fuel in the fuel tank to expand.

BRIEF DESCRIPTION OF THE DRAWINGS

The above and further advantages of the invention may be better understood by referring to the following description in conjunction with the accompanying drawings and which.

DESCRIPTION OF THE PREFERRED EMBODIMENT

Figure 1:
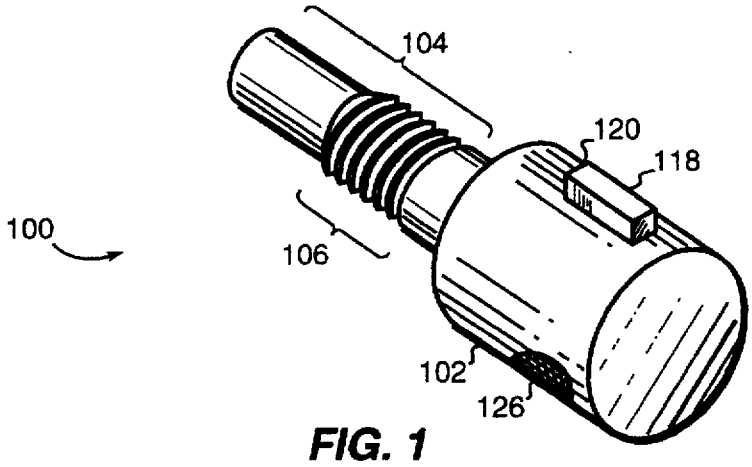
FIG. 1 illustrates a vent fitting according to the present invention.
Figure 2:
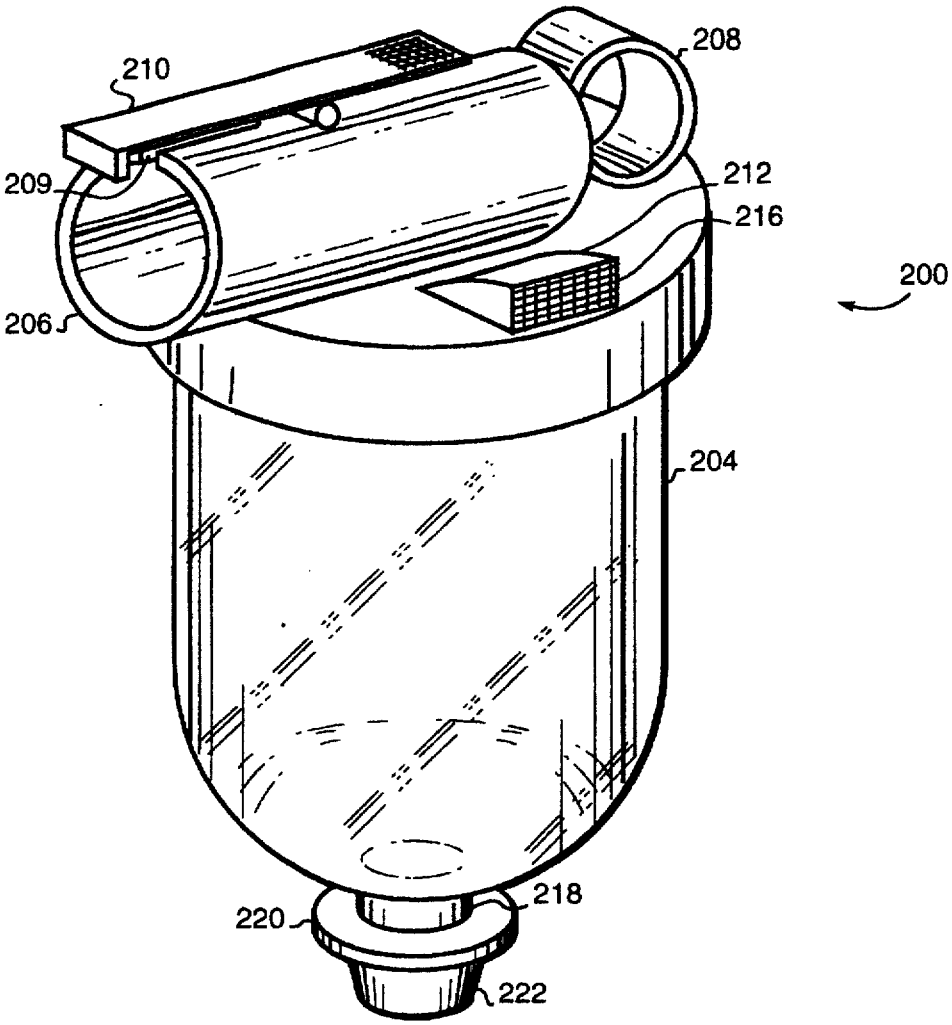
FIG. 2 illustrates a detachable part, including a coupler, recovery tank, valve and drain, according to the present invention.
Figure 3:
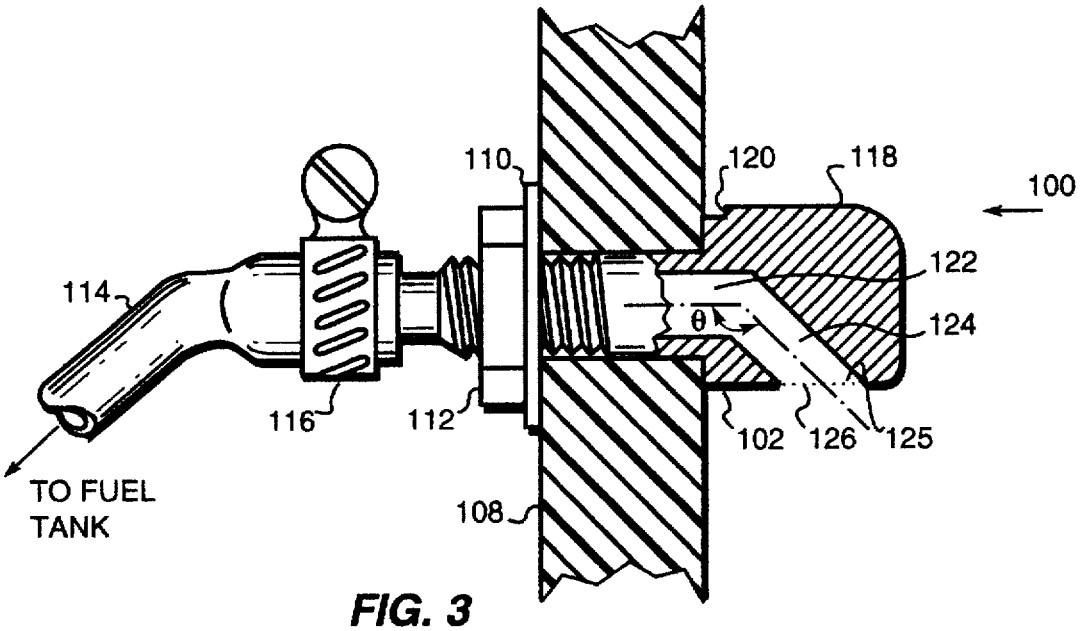
FIG. 3 is a partially-cutaway view of the vent fitting of FIG. 1 after it has been mounted in a hull of a boat.

As shown in FIGS. 1 and 2, the invention provides a vent fitting 100 (best illustrated in FIG. 1) and a detachable part 200 (best illustrated in FIG. 2) that can be attached to the vent fitting. The vent fitting 100 has a head 102 attached to a substantially cylindrical body 104, and it has a threaded portion 106 by which it can be mounted (as shown in FIG. 3) in a hull 108 of a boat (not shown) using a washer 110 and a nut 112. The vent fitting 100 can then be connected by suitable plumbing, such as by a hose 114 and a clamp 116, to a vent opening of a fuel tank (not shown). The head 102 has a longitudinal male key 118, a rear portion of which forms a notch 120. The vent fitting has a longitudinal bore 122 through its body 104 and a lateral bore 124 in its head 102. The two bores intersect and form an angle θ that is between 100° and 180°, preferably between 125° and 145°. The lateral bore defines a hole 125 in the head 102 and a screen 126 covers the hole to prevent the introduction of foreign substances into the vent fitting 100. Since the vent fitting 100 is in fluid communication with the interior of the fuel tank, fuel vapor, other gasses and, of course, fuel can escape or be forced from the fuel tank through the hole 125 in the vent fitting.

Figure 4:
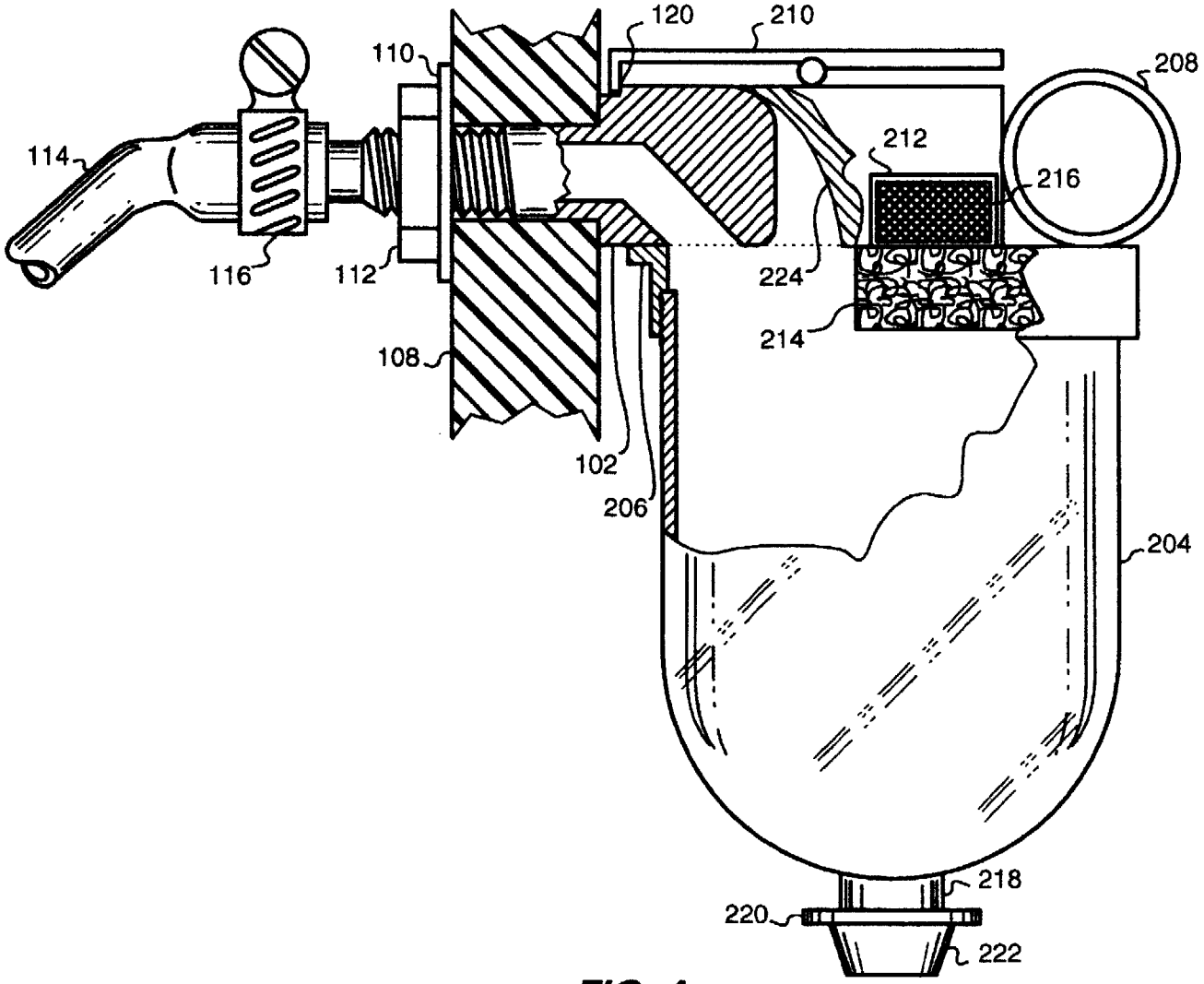
FIG. 4 is a partially-cutaway view of the detachable part of FIG. 2 attached to the vent fitting of FIG. 3.

Referring again to FIG. 2, the detachable part 200 has a substantially closed fuel recovery tank 204 connected to a coupler 206. A handle 208 facilitates carrying the detachable part 200 and attaching it to and detaching it from the vent fitting 100. As shown in FIG. 4, when the detachable part 200 is attached to the vent fitting 100, the coupler 206 mates with the vent fitting, and thus the fuel recovery system and the fuel tank form a substantially closed system. A female longitudinal key 209 (FIG. 2) aligns with the male longitudinal key 118 on the head 102 of the vent fitting 100 to prevent the detachable part 200 from rotating about the vent fitting. As best seen in FIG. 4, a spring-loaded latch 210 coacts with the notch 120 on the head 102 of the vent fitting 100 to detachably secure the coupler to the vent fitting, even when the boat travels over rough water.

The detachable portion 200 also has a recovery tank vent 212 and a vapor-trapping, e.g. activated charcoal, filter 214. A screen 216 covers the recovery tank vent 212. Gases from the fuel tank that escape through the vent fitting 100 pass through the filter 214 and then out the recovery tank vent 212. The filter 214 traps fuel vapors, thus preventing air pollution, and it can be replaced when it becomes saturated.

Figure 5:
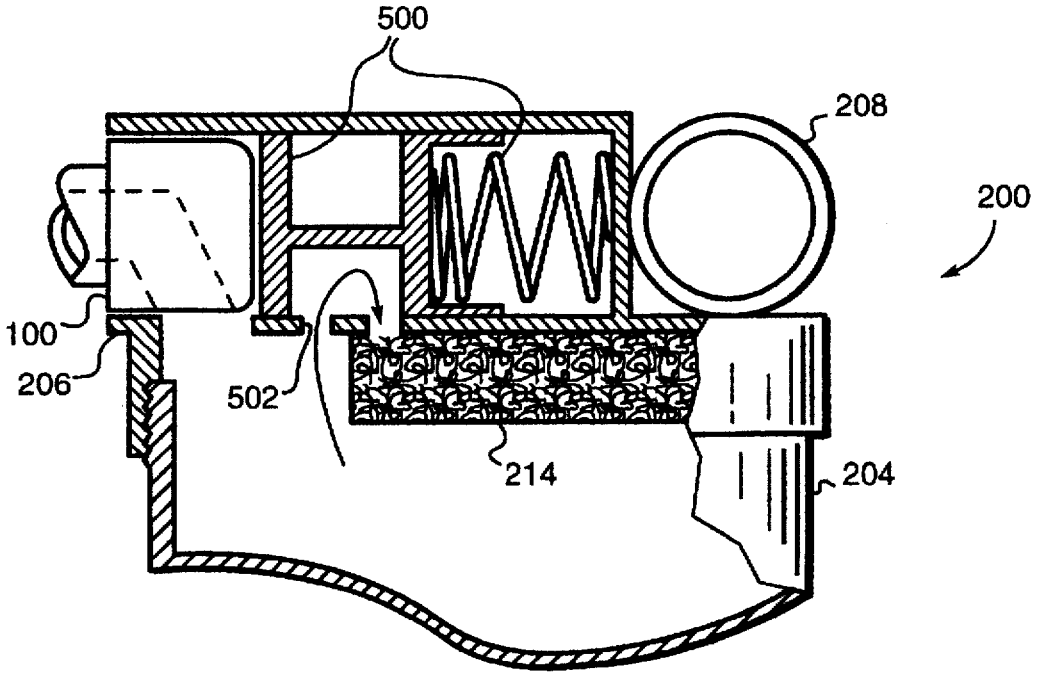
FIG. 5 is a partially-cutaway view of an alternative embodiment of the detachable part of FIG. 2 attached to the vent fitting of FIG. 3.

Optionally, as shown in FIG. 5, the invention includes a spring-loaded plunger 500 to close off the coupler 206 when the detachable part 200 is detached from the vent fitting 100, thus preventing recovered fuel or vapors from escaping from the fuel recovery tank 204. The plunger 500 also closes off a vent passage 502, which prevents recovered fuel or vapors from escaping through the vapor-trapping filter 214 and the recovery tank vent 212 (FIG. 4). Alternatively, other arrangements, such as a spring-loaded, gravity-operated or normally-operated flap, are acceptable as long as they prevent recovered fuel from escaping from the recovery tank 204. Such means for closing off the coupler when the coupler is detached from the vent fitting can be located anywhere between the opening of the coupler and the fuel recovery tank.

Figure 6:
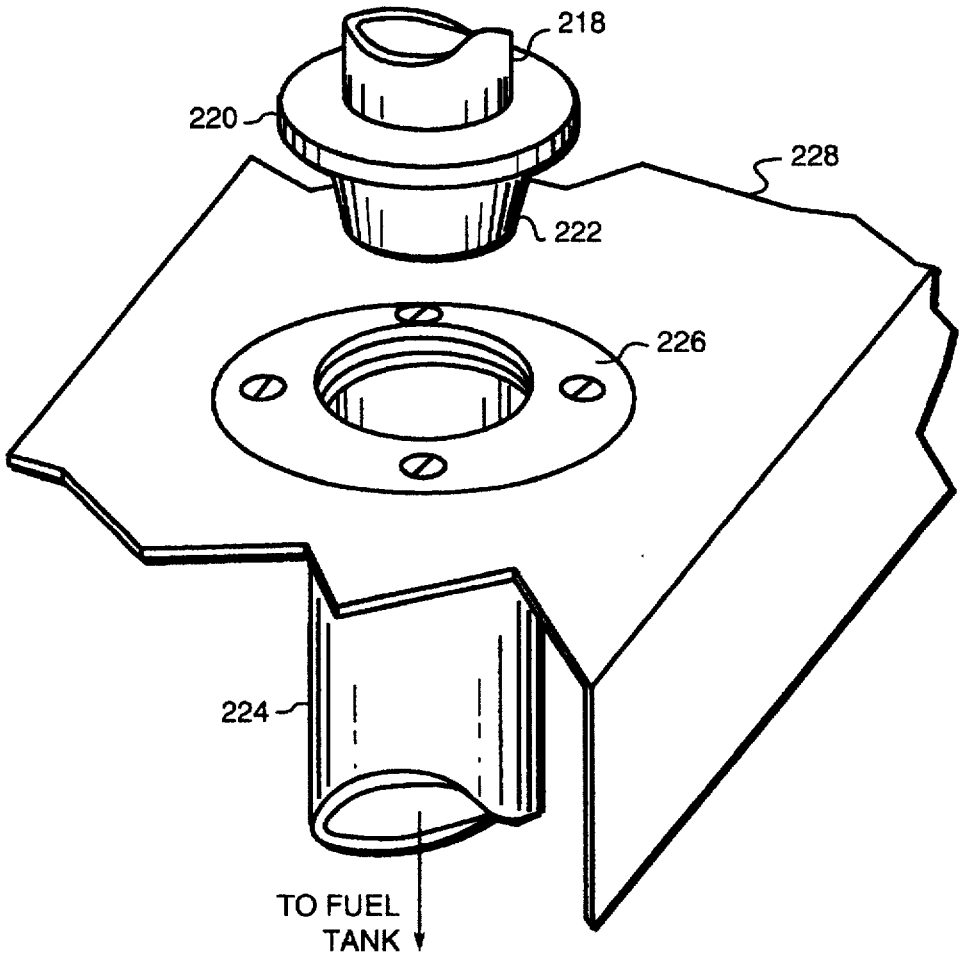
FIG. 6 illustrates a filler neck of a fuel tank and a bottom portion of the detachable part of FIG. 2.

Referring again to FIG. 2, a valve 218, a valve actuator 220 and a drain 222 are connected to the bottom of the recovery tank 204 to facilitate reintroducing recovered fuel into the boat's fuel tank through its filler neck. As shown in FIG. 6, when the detachable part 200 is detached from the vent fitting 100, the drain 222 can be inserted into a filler neck 224. The filler neck 224 is typically mounted to a deck 228 of the boat and is connected to a fuel fill opening of the fuel tank (not shown). As the detachable part 200 is pressed down, the valve actuator 220 contacts a flange 226 of the filler neck 224, the valve 218 opens and the recovered fuel flows under gravity from the recovery tank 204, through the valve and drain and into the fuel tank.

Although the invention is exemplified by a preferred embodiment, those skilled in the art will recognize that several variations and modifications are possible while remaining within the scope of the invention. For example, the spring-loaded latch 210 of the detachable part 200 and the notch 120 in the head 102 of the vent fitting 100 comprise a coacting means for securing the coupler 206 to the vent fitting, but other designs are possible, provided they enable the coupler to remain mated with the vent fitting despite vibration, acceleration or other movement of the boat. For example, the vent fitting can have an externally-threaded portion and the coupler can have a captured internally-threaded member that engages the threaded portion of the vent. Furthermore, the preferred embodiment has a male longitudinal key 118 on the vent fitting 100 that aligns with the female longitudinal key 209 on the coupler 206, but other arrangements, such as a spline, can be used to prevent rotation of the detachable part 200 with respect to the vent fitting. If the angle of the longitudinal bore 122 (FIG. 3) and the lateral bore 124 of the vent fitting 100 is large, the detachable part 200 (FIG. 4) may require a baffle 224 to deflect fuel discharged from the hole 125 in the vent fitting.

It will therefore be seen that I have developed a fuel recovery system, which can be utilized with a variety of boats and under a variety of circumstances. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank;

(B) a coupler for detachably mating with the vent fitting;

(C) coacting means on the vent fitting and coupler for detachably securing the coupler to the vent fitting when the coupler is mated with the vent fitting;

(D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank;

(E) a drain for emptying the recovery tank, the drain being adapted for mating, when the coupler is unmated from the vent fitting, with a filler neck that is connected to the fuel fill opening of the fuel tank; and (F) a valve connected between the recovery tank and the drain, wherein the drain is in fluid communication with the recovery tank when the valve is open, and wherein the valve opens when the drain is mated with the filler neck, whereby when the drain is mated with the filler neck, the discharged fuel in the recovery tank flows under gravity from the recovery tank, through the valve and drain and then into the fuel tank.

2. The fuel recovery system defined in claim 1, wherein:

(A1) the vent fitting comprises a substantially cylindrical body and a head attached to one end of the body;

(A2) the body has a longitudinal bore therethrough and an externally threaded portion;

(A3) the head has a lateral bore that intersects the longitudinal bore at an angle of between 100° and 180°; and (A4) the head has a screen at an end of the lateral bore opposite the intersection of the lateral bore and the longitudinal bore.

3. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank, wherein:

(1) the vent fitting comprises a substantially cylindrical body and a head attached to one end of the body;

(2) the body has a longitudinal bore therethrough and an externally threaded portion;

(3) the head has a lateral bore that intersects the longitudinal bore at an angle of between 100° and 180°; and (4) the head has a screen at an end of the lateral bore opposite the intersection of the lateral bore and the longitudinal bore;

(B) a coupler for detachably mating with the vent fitting;

(C) coacting means on the vent fitting and coupler for detachably securng the coupler to the vent fitting when the coupler is mated with the vent fitting; and (D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank.

4. The fuel recovery system defined in claim 3, wherein the angle is between 125° and 145°.

5. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank, the vent fitting having a first longitudinal key;

(B) a coupler for detachably mating with the vent fitting, the coupler having a second longitudinal key that aligns with the first longitudinal key when the coupler is mated with the vent fitting, thereby positively locking the coupler against rotation around the vent fitting;

(C) coacting means on the vent fitting and coupler for detachably securng the coupler to the vent fitting when the coupler is mated with the vent fitting; and (D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank.

6. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank;

(B) a coupler for detachably mating with the vent fitting;

(C) coacting means on the vent fitting and coupler comprising a spring-loaded latch for detachably securing the coupler to the vent fitting when the coupler is mated with the vent fitting; and (D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank.

7. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank;

(B) a coupler for detachably mating with the vent fitting;

(C) coacting means on the vent fitting and coupler for detachably securing the coupler to the vent fitting when the coupler is mated with the vent fitting, the securing means comprising a threaded portion on the vent fitting and a threaded member associated with the coupler, the threaded member being configured to engage the threaded portion of the vent fitting; and (D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank.

8. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank;

(B) a coupler for detachably mating with the vent fitting;

(C) coacting means on the vent fitting and coupler for detachably securng the coupler to the vent fitting when the coupler is mated with the vent fitting;

(D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank;

(E) venting means for venting the recovery tank; and (F) a filter between the recovery tank and the venting means for reducing the amount of fuel vapor that escapes through the venting means.

9. A fuel recovery system for a fuel tank in a boat, the fuel tank having an interior, a fuel fill opening and a vent opening and being susceptible to having fuel inadvertently forced from the vent opening, the system comprising:

(A) a vent fitting for connection to the vent opening of the fuel tank so that the vent fitting is in fluid communication with the interior of the fuel tank;

(B) a coupler for detachably mating with the vent fitting;

(C) coacting means on the vent fitting and coupler for detachably securng the coupler to the vent fitting when the coupler is mated with the vent fitting;

(D) a substantially closed recovery tank connected to the coupler, the recovery tank permitting the coupler to remain mated to the vent fitting while the boat travels about, wherein when the vent fitting is connected to the vent opening of the fuel tank and the coupler is mated to the vent fitting, the fuel recovery system and fuel tank form a substantially closed system so that when fuel is inadvertantly forced from the vent opening of the fuel tank and is then discharged through the vent fitting, the discharged fuel flows into the recovery tank;

(E) means for venting the recovery tank; and (F) means for closing off the coupler when the coupler is detached from the vent fitting.

* * * * *